US009184545B2

(12) United States Patent
Chen et al.

(10) Patent No.: US 9,184,545 B2
(45) Date of Patent: Nov. 10, 2015

(54) COMBINATION USB CONNECTOR

(71) Applicant: Ting-Chi Chen, New Taipei (TW)

(72) Inventors: Ting-Chi Chen, New Taipei (TW); Su-Yung Chou, New Taipei (TW); Yi-Chieh Lin, New Taipei (TW); Te-Fu Lu, New Taipei (TW)

(73) Assignee: Ting-Chi Chen, New Taipei (TW)

( * ) Notice: Subject to any disclaimer, the term of this patent is extended or adjusted under 35 U.S.C. 154(b) by 80 days.

(21) Appl. No.: 14/168,427

(22) Filed: Jan. 30, 2014

(65) Prior Publication Data

US 2015/0214669 A1 Jul. 30, 2015

(51) Int. Cl.

| | |
|---|---|
| ***H01R 9/03*** | (2006.01) |
| ***H01R 13/659*** | (2011.01) |
| ***H01R 31/06*** | (2006.01) |
| ***H01R 13/40*** | (2006.01) |

(52) U.S. Cl.

CPC ..... *H01R 13/659* (2013.01); *H01R 13/40* (2013.01); *H01R 31/06* (2013.01)

(58) Field of Classification Search

CPC ..... H01R 13/65802; H01R 23/6873; H01R 23/025; H01R 23/7073

USPC ..... 439/607.01, 607.23, 607.24, 607.26, 439/607.4, 607.54, 660, 676

See application file for complete search history.

(56) References Cited

U.S. PATENT DOCUMENTS

| | | | | |
|---|---|---|---|---|
| 6,659,804 | B2 * | 12/2003 | Nishio et al. | 439/660 |
| 7,625,243 | B2 * | 12/2009 | Chen et al. | 439/660 |
| 7,798,861 | B2 * | 9/2010 | Liu et al. | 439/660 |
| 7,909,654 | B2 * | 3/2011 | He et al. | 439/660 |
| 7,942,704 | B2 * | 5/2011 | Ko et al. | 439/660 |
| 8,123,558 | B2 * | 2/2012 | Su et al. | 439/607.01 |
| 8,123,562 | B2 * | 2/2012 | Zhou et al. | 439/607.48 |
| 8,197,281 | B2 * | 6/2012 | Yang | 439/499 |
| 8,801,469 | B2 * | 8/2014 | Wu et al. | 439/660 |
| 8,992,256 | B2 * | 3/2015 | Chen et al. | 439/607.23 |

FOREIGN PATENT DOCUMENTS

TW 201421835 A 6/2014

* cited by examiner

*Primary Examiner* — Thanh Tam Le

(74) *Attorney, Agent, or Firm* — Muncy, Geissler, Olds & Lowe, P.C.

(57) ABSTRACT

A combination USB connector includes an electrical insulating terminal holder including a holder body and a front extension, a conducting terminal set including conducting terminals, signal terminals and transmission terminals and respectively mounted in the holder body and front extension of the electrical insulating terminal holder, an EMI shielding shell including a main shell part surrounding the holder body to constitute a USB (USB3.0 or 2.0) connector, a sub shell part surrounding the front extension to constitute a micro USB connector and a mount connected between the main shell part and the sub shell part, and a swivel adapter including a terminal holder pivoted to the mount of the EMI shielding shell, adapter terminals mounted in the terminal holder and a metal shielding casing surrounding the terminal holder to constitute a USB2.0 connector.

15 Claims, 11 Drawing Sheets

COMBINATION USB CONNECTOR

BACKGROUND OF THE INVENTION

1. Field of the Invention

The present invention relates to electrical connectors, and more particularly to a combination USB connector, which has a swivel adapter pivotally connected thereto to provide a wide range of applications and to assure a high level of application safety.

2. Description of the Related Art

Following fast development of computer electronic technology, many high mobility electrical and electronic apparatus are well developed and widely used by people for different applications, bringing convenience to people and making people's life more comfortable. Further, high-speed, high-power and sophisticated mobile electrical and electronic devices and related products with large capacity and low profile characteristics have been continuously created. Further, many different transmission interfaces and connectors are widely used in electrical and electronic products for power and data transmission. For connecting different component parts, different transmission interfaces or connectors of different sizes and configurations must be used. Therefore, an electrical or electronic device needs to provide sufficient installation space for the installation of different types of transmission interfaces and connectors.

Further, it is the market trend to create mobility electronic apparatuses having light, thin, short and small characteristics. In consequence, circuit board electronic components must be made extremely strong, small and precise. Further, many different male and female electrical connectors are used in an electronic apparatus to connect different components and parts to a circuit board for the connection of mating electronic cards and/or connectors. These electrical connectors occupy much circuit layout space of the circuit board and the inside space of the electronic apparatus. It is quite important to fully utilize the circuit layout space of a circuit board and the internal space of an electronic apparatus.

The inventor of the present invention filed a patent application, entitled "Combination USB connector", on Jun. 11, 2013, under Application Number 102120771. According to this design, as shown in FIG. 11, the combination USB connector A comprises an electrical insulating terminal holder B having a front extension B1, an EMI (electromagnetic interference) shielding shell C surrounding the electrical insulating terminal holder B, a sub shielding shell C1 forwardly extended from the EMI shielding shell C and surrounding the front extension B1, and conducting terminals mounted in the electrical insulating terminal holder B and the front extension B1. When connecting this design of combination USB connector A to an external mating connector D, the power terminals of the external mating connector D will touch the surface of the sub shielding shell C1 and then electrically contact the power terminals B2 in the electrical insulating terminal holder B. A transient high current (or high voltage) can be produced during transmission of power supply through the power terminals of the external mating connector D and the power terminals B2 in the electrical insulating terminal holder B, affecting signal transmission stability. A short circuit may occur when a transient high current (or high voltage) is produced during power transmission.

Therefore, there is room for improvement on the aforesaid prior art design.

SUMMARY OF THE INVENTION

The present invention has been accomplished under the circumstances in view. It is one object of the present invention to provide a combination USB connector, which requires less installation space and provides a wide range of applications.

To achieve this and other objects of the present invention, a combination USB connector in accordance with one embodiment of the present invention comprises an electrical insulating terminal holder, a conducting terminal set including conducting terminals, signal terminals and transmission terminals, an EMI (electromagnetic interference) shielding shell surrounding the electrical insulating terminal holder, and a swivel adapter pivotally connected to the EMI shielding shell. The EMI shielding shell comprises a main shell part, a main accommodation chamber defined in the main shell part and adapted to accommodate the holder body of the electrical insulating terminal holder, a sub shell part forwardly extended from a front bottom side of the main shell part, a sub accommodation chamber defined in the sub shell part in communication with the main accommodation chamber and adapted to accommodate the front extension of the electrical insulating terminal holder, and an open type mount located at the main shell part between the main accommodation chamber and the sub accommodation chamber. The EMI shielding shell surrounds the electrical insulating terminal holder and the conducting terminal set, and the holder body of the electrical insulating terminal holder matched with the conducting terminals and signal terminals of the conducting terminal set and the main shell part of the EMI shielding shell to constitute a USB (USB3.0 or 2.0) connector. Further, the front extension of the electrical insulating terminal holder matches with the transmission terminals of the conducting terminal set and the first sub shell part of the EMI shielding shell to constitute a micro USB connector. Further, the swivel adapter is pivotally connected to the mount of the EMI shielding shell. When the swivel adapter is closed on the mount of the EMI shielding shell, the terminal holder and metal shielding casing of the swivel adapter cover the top side of the sub shell part of the EMI shielding shell, and rear bearing portions of the adapter terminals are respectively electrically abutted against mating contact end pieces of the signal terminals, and thus middle contact portions of the adapter terminals and the tongue plate are matched with the metal shielding casing to constitute a USB (USB2.0) connector that can be electrically connected to an external mating electrical connector without causing contact between the power terminals of the external mating electrical connector and the sub shell part of the EMI shielding shell, assuring a high level of application safety.

Further, the conducting terminal set comprises 5 pcs of conducting terminals, 4 pcs of signal terminals, and 5 pcs of transmission terminals. The 5 pcs of conducting terminals are classified as $1^{st}$ grounding terminal, $1^{st}$ differential signal terminal, $2^{nd}$ differential signal terminal, $3^{rd}$ differential signal terminal and $4^{th}$ differential signal terminal. The 4 pcs of signal terminals are classified as $5^{th}$ differential signal terminal, $6^{th}$ differential signal terminal, $1^{st}$ power terminal, and $2^{nd}$ grounding terminal. The transmission terminals are classified as $7^{th}$ differential signal terminal, $8^{th}$ differential signal terminal, $2^{nd}$ power terminal, $3^{rd}$ grounding terminal and supplementary transmission terminal. The $7^{th}$ differential signal terminal, the $8^{th}$ differential signal terminal, the $2^{nd}$ power terminal and the $3^{rd}$ grounding terminal are respectively extended from the mating contact end pieces of the transmission terminals. The supplementary transmission terminal is connected to an inner side of the $3^{rd}$ grounding terminal. Further, the main shell part of the EMI shielding shell, the 5 pcs of conducting terminals and the 4 pcs of signal terminals constitute a USB3.0 connector. Further, the sub shell part of the EMI shielding shell, the front extension of the electrical insulating terminal holder and the 5 pcs of transmission terminals constitute a micro USB connector.

Further, the adapter terminals of the swivel adapter are classified as $9^{th}$ differential signal terminal, $10^{th}$ differential signal terminal, $3^{rd}$ power terminal, and $4^{th}$ grounding terminal. The $9^{th}$ differential signal terminal and the $10^{th}$ differential signal terminal are arranged in parallel on the middle. The $3^{rd}$ power terminal and the $4^{th}$ grounding terminal are arranged in parallel at two opposite lateral sides.

Further, each signal terminal further comprises a first bend vertically downwardly extended from the mating contact end piece thereof, an extension arm extended from the first bend, and a second bend extended from the extension arm. Further, the transmission terminals are respectively horizontally connected to the second bends of the signal terminals. Further, the contact tips of the $2^{nd}$ power terminal and $3^{rd}$ grounding terminal are shaped like an open loop, each defining two contact surfaces. Further, the supplementary transmission terminal is connected to an inner side of the $3^{rd}$ grounding terminal, enabling the 5 pcs of transmission terminals to fit USB/OTG specifications.

DETAILED DESCRIPTION OF THE PREFERRED EMBODIMENT

Figure 1:
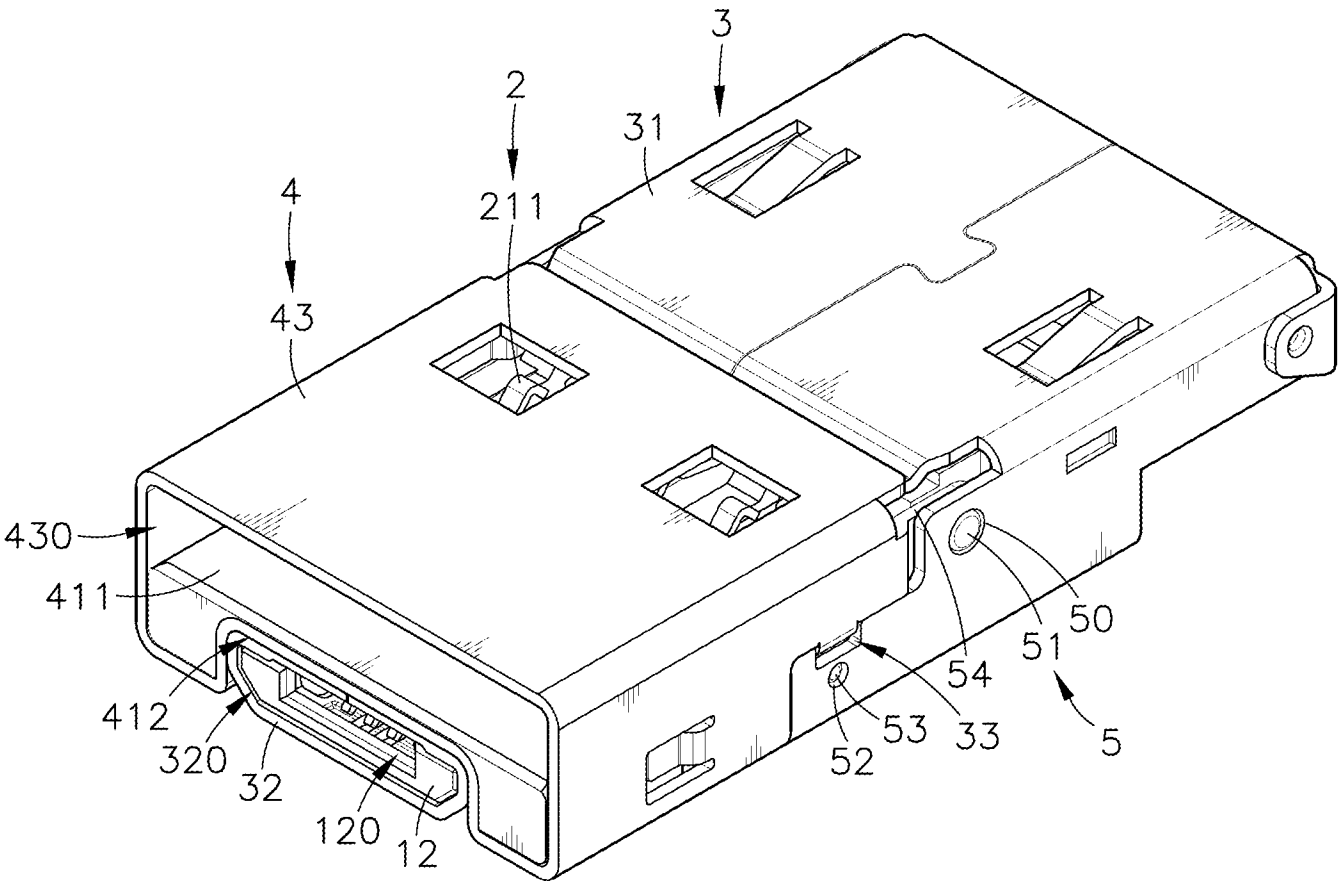
FIG. 1 is an oblique top elevation of a combination USB connector in accordance with a first embodiment of the present invention.
Figure 2:
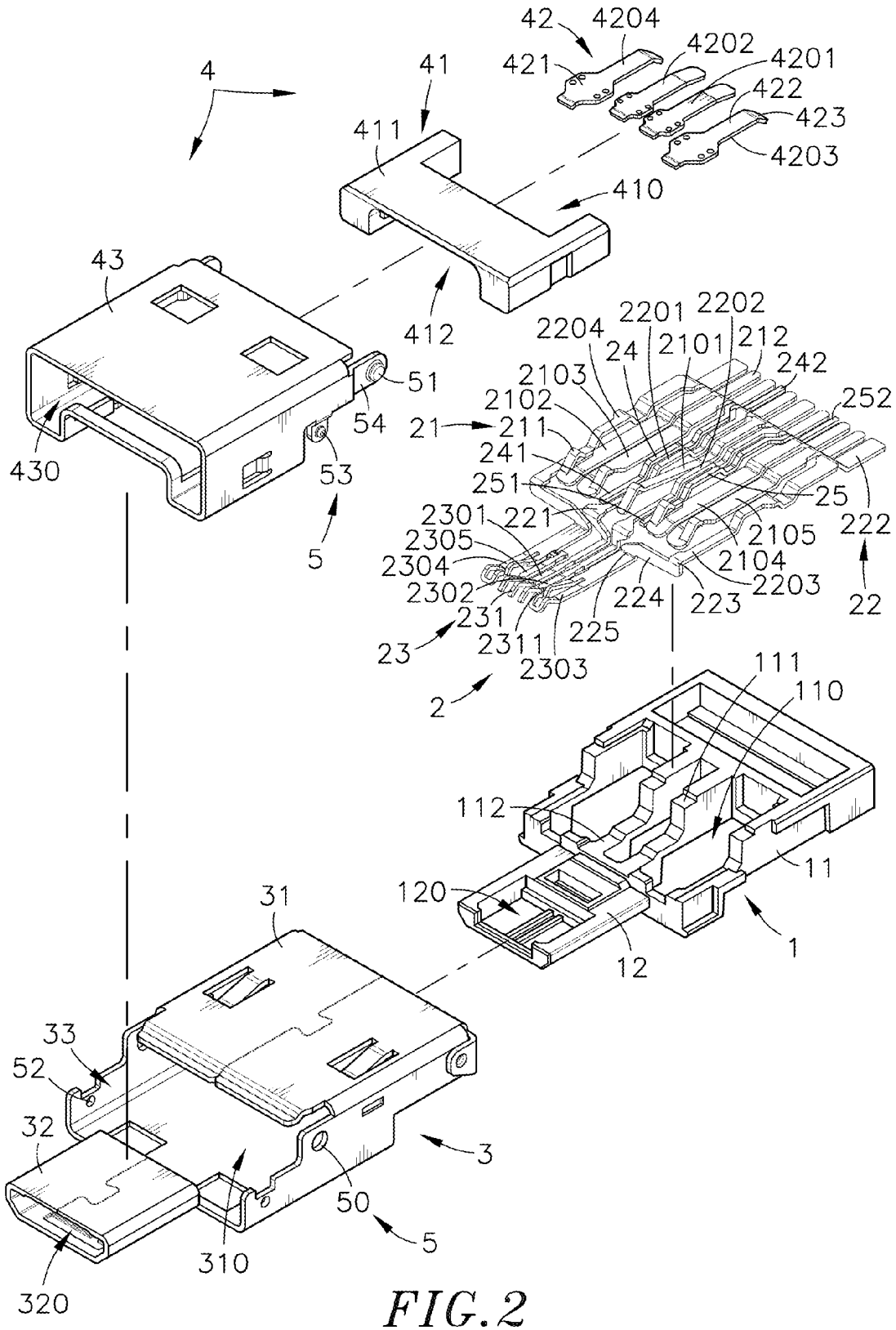
FIG. 2 is an exploded view of the combination USB connector in accordance with the first embodiment of the present invention.
Figure 3:
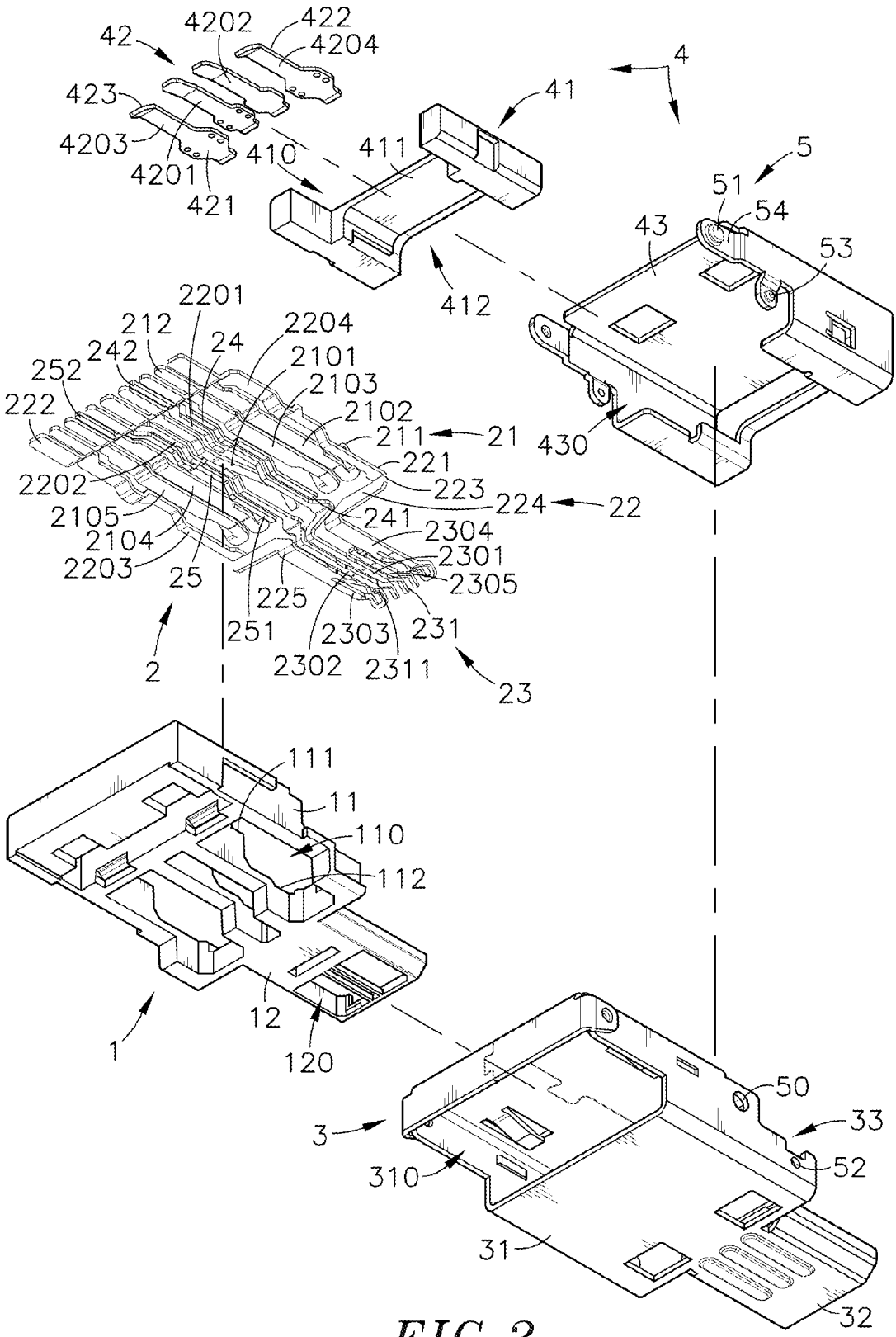
FIG. 3 corresponds to FIG. 2 when viewed from another angle.
Figure 4:
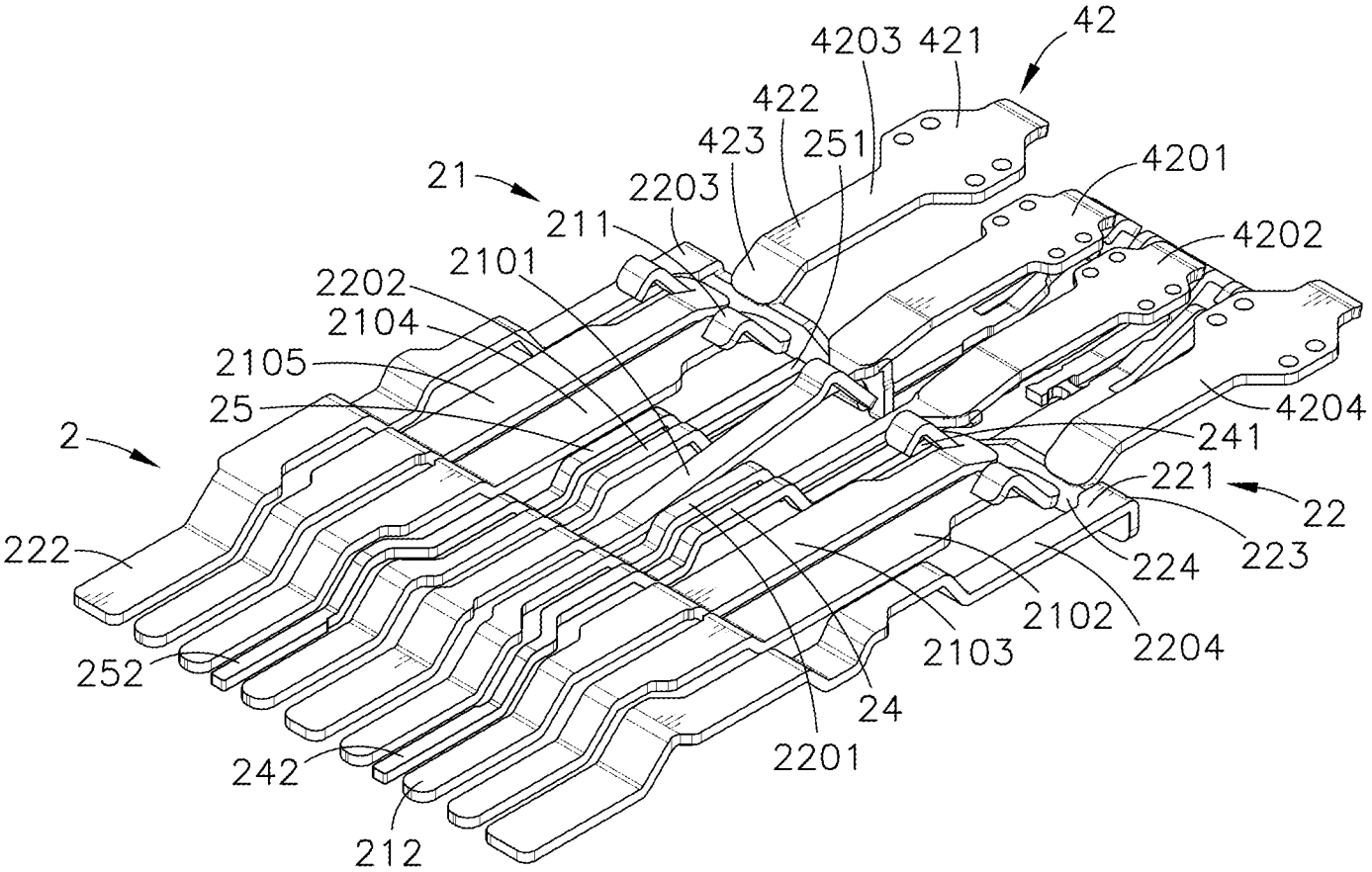
FIG. 4 is a top plain view illustrating the arrangement of the conducting terminal set and adapter terminal set of the combination USB connector in accordance with the first embodiment of the present invention.
Figure 5:
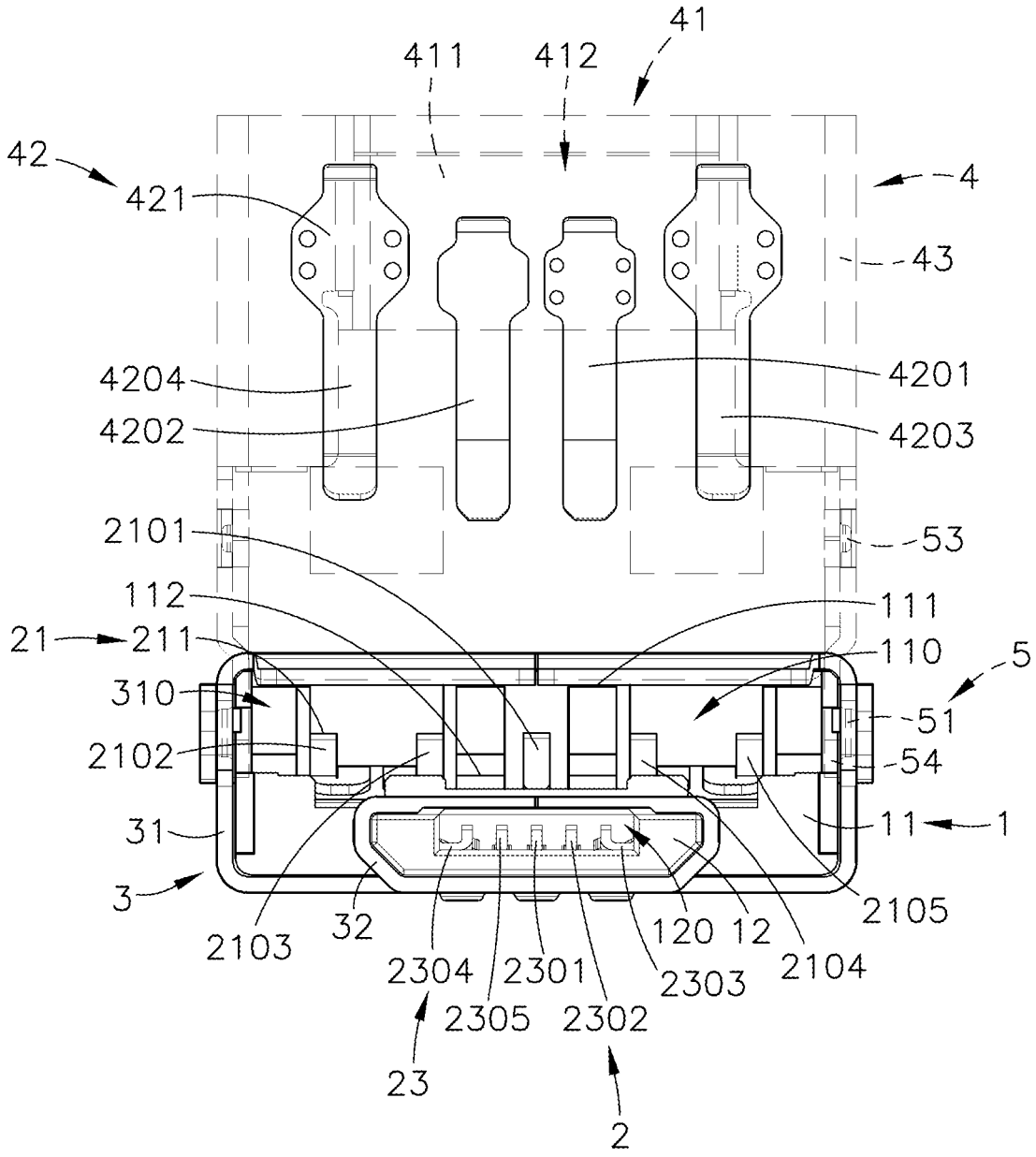
FIG. 5 is a schematic front view of the combination USB connector in accordance with the first embodiment of the present invention.
Figure 6:
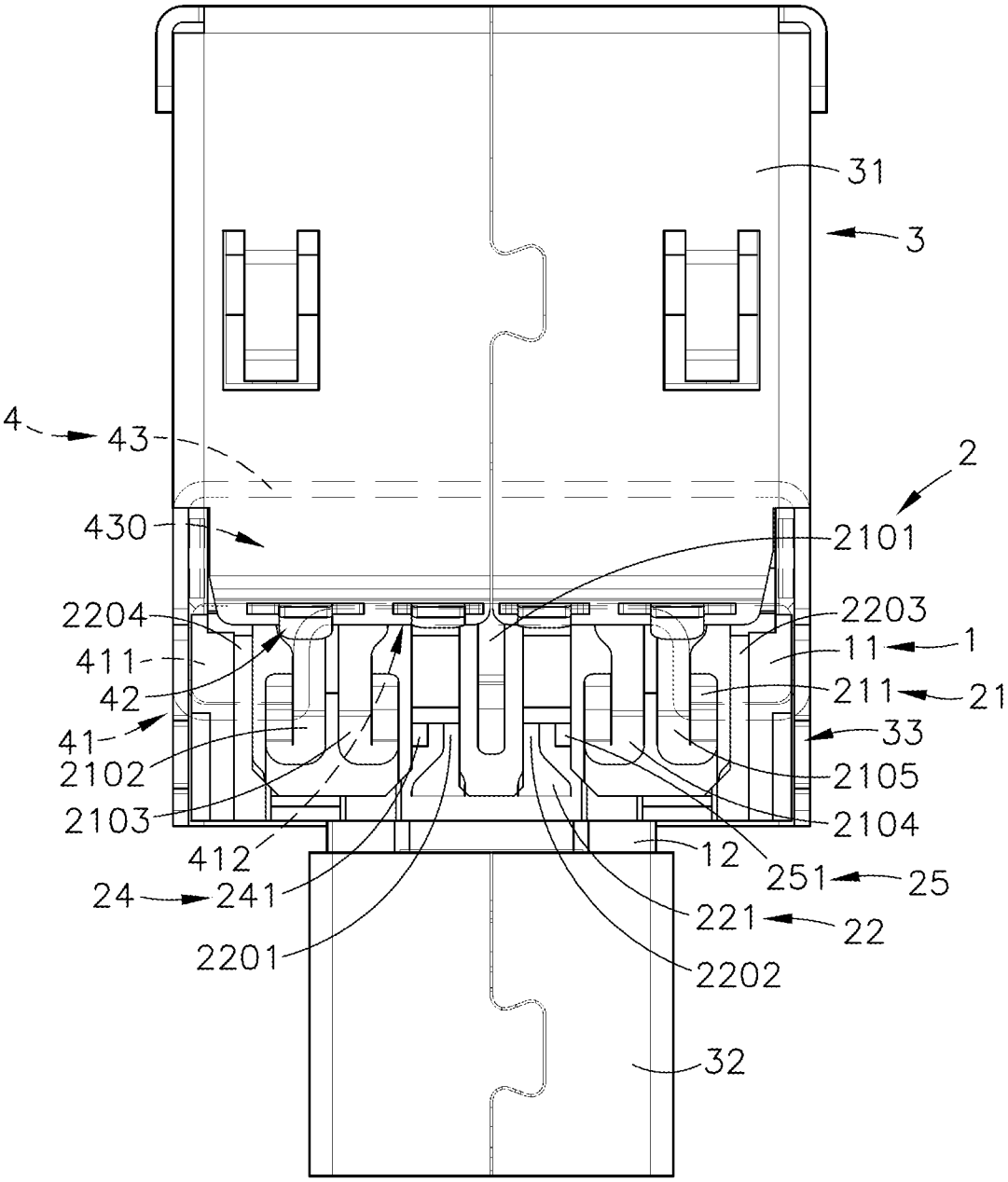
FIG. 6 is a schematic top view of the combination USB connector in accordance with the first embodiment of the present invention.
Figure 7:
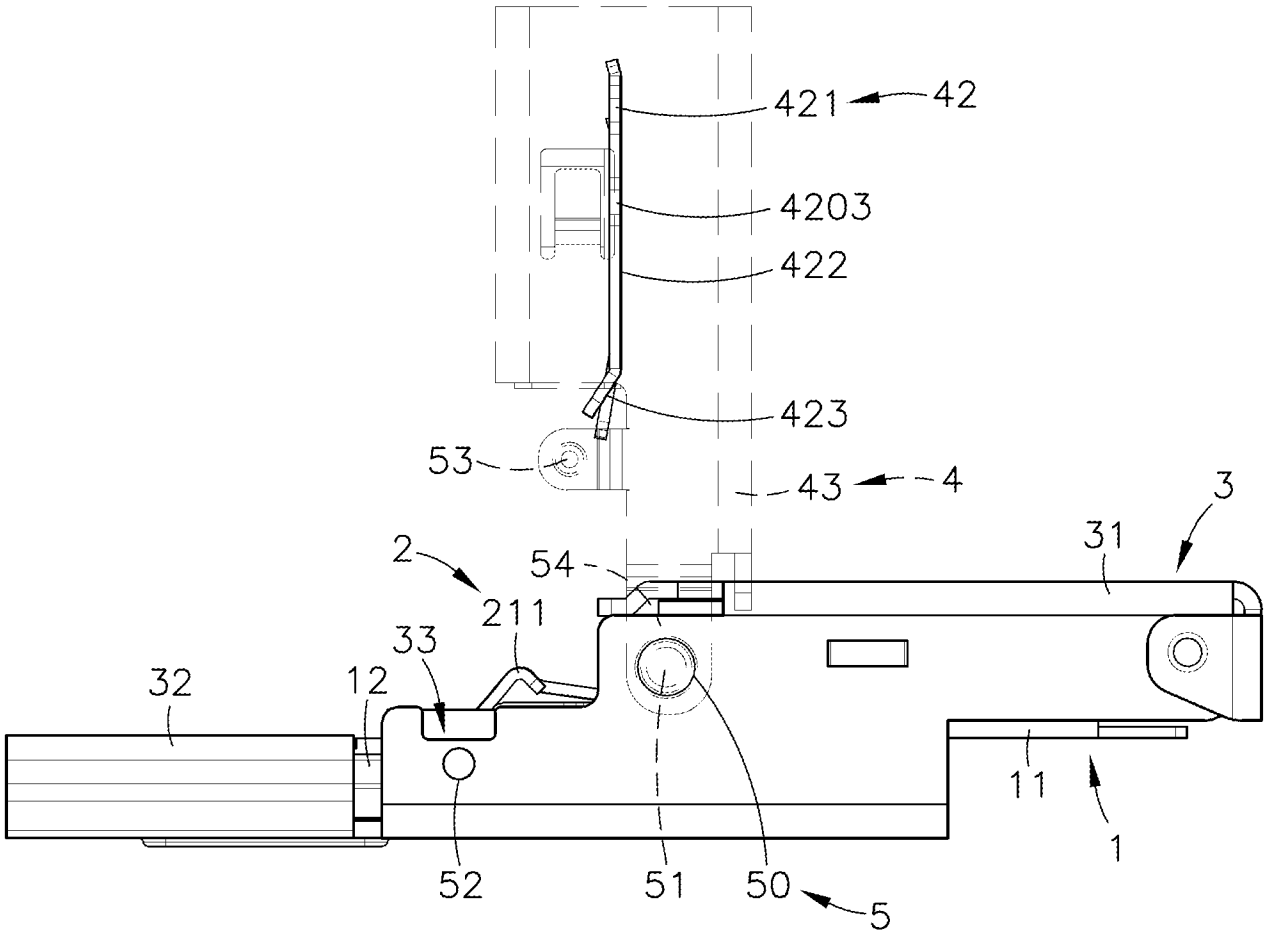
FIG. 7 is a schematic side view of the combination USB connector in accordance with the first embodiment of the present invention.
Figure 8:
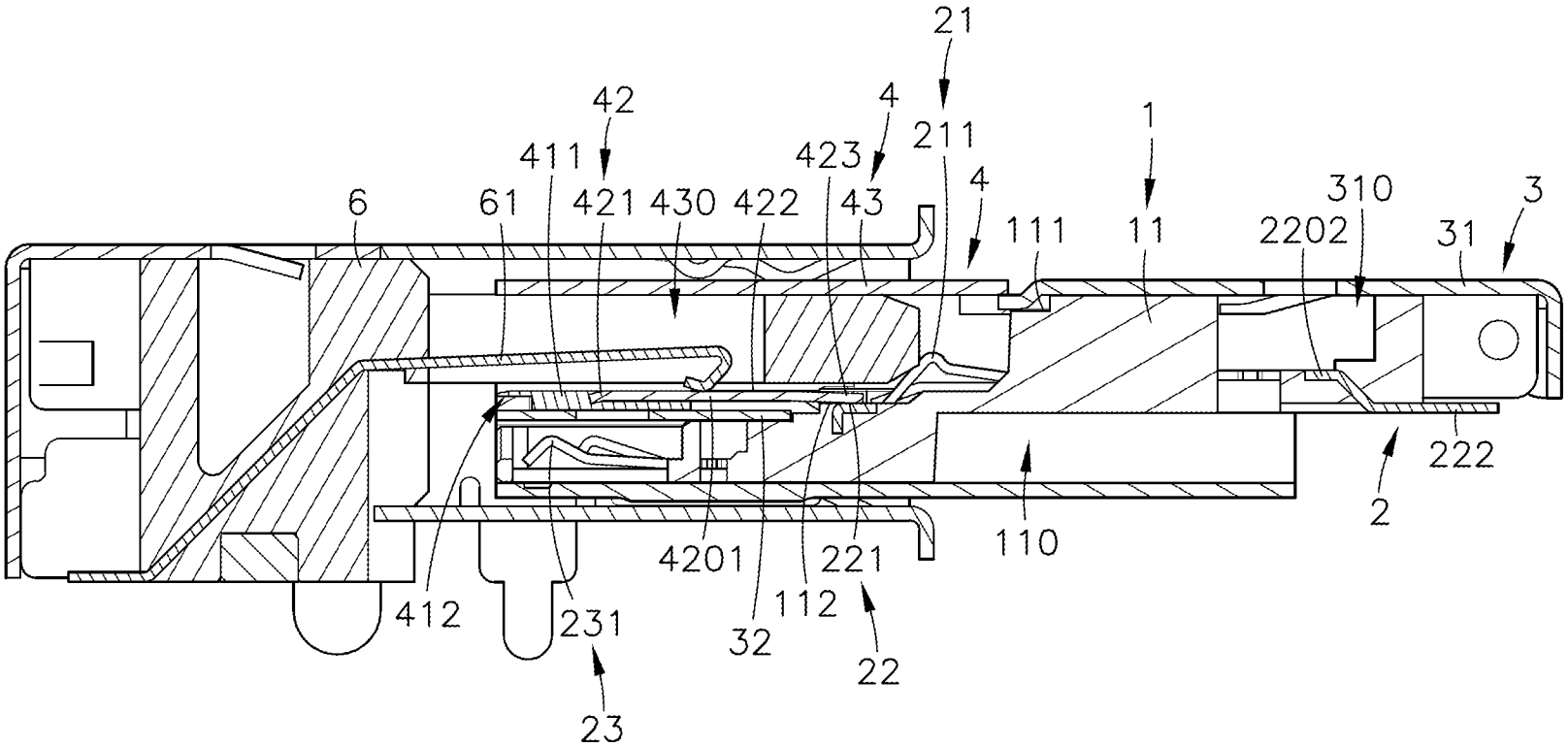
FIG. 8 is a sectional side view of the combination USB connector in accordance with the first embodiment of the present invention, illustrating the swivel adapter in the open position.

Referring to FIGS. 1-4, a combination USB connector in accordance with a first embodiment of the present invention is shown. As illustrated, the combination USB connector comprises an electrical insulating terminal holder 1, a conducting terminal set 2, an EMI (electromagnetic interference) shielding shell 3, and a swivel adapter 4.

The electrical insulating terminal holder 1 comprises a holder body 11, a plurality of partition ribs 111 and elongated openings 110 alternatively disposed in a middle part of the holder body 11, a plurality of bearing surface portions 112 respectively located at respective front sides of the partition ribs 111, a front extension 12 forwardly extended from a lower middle part of a front side of the holder body 11, and an accommodation open space 120 defined in the front extension 12.

The conducting terminal set 2 comprises a plurality of conducting terminals 21, a plurality of signal terminals 22, and a plurality of transmission terminals 23. Each conducting terminal 21 comprises a mating contact end portion 211 located at a front end thereof and reversely curved, and a bonding end portion 212 located at an opposite rear end thereof. Each signal terminal 22 comprises a mating contact end piece 221 located at a front end thereof, a bonding end piece 222 located at an opposite rear end thereof, a first bend 223 vertically downwardly extended from the mating contact end piece 221, an extension arm 224 extended from the first bend 223, and a second bend 225 extended from the extension arm 224. The transmission terminals 23 are respectively horizontally connected to the second bends 225 of the signal terminals 22, and respectively terminating in a respective contact tip 231.

The EMI shielding shell 3 comprises a main shell part 31, a main accommodation chamber 310 defined in the main shell part 31, a sub shell part 32 forwardly extended from a front bottom side of the main shell part 31, a sub accommodation chamber 320 defined in the sub shell part 32 in communication with the main accommodation chamber 310, and an open type mount 33 located at the main shell part 31 between the main accommodation chamber 310 and the sub accommodation chamber 320.

The swivel adapter 4 comprises an insulative terminal holder 41, a set of adapter terminals 42, and a metal shielding casing 43. The terminal holder 41 comprises a tongue plate 411 defining a bottom recess 412, and an opening 410 defined in a rear side relative to the tongue plate 411. The adapter terminals 42 are mounted in the tongue plate 411, each having a front mounting portion 421 mounted in the tongue plate 411, a rear bearing portion 423 suspending in the opening 410, and a middle contact portion 422 connected between the front mounting portion 421 and the rear bearing portion 423 and suspending in the opening 410. The metal shielding casing 43 defined therein an accommodation chamber 430 that accommodates the insulative terminal holder 41 and the adapter terminals 42 in the insulative terminal holder 41.

When assembling the combination USB connector, mount the conducting terminals 21, the signal terminals 22 and the transmission terminals 23 in the electrical insulating terminal holder 1 in such a manner that the mating contact end portions 211 of the conducting terminals 21 are respectively suspended in the elongated openings 110 within the holder body 11, and the bonding end portions 212 of the conducting terminals 21 are respectively extended out of an opposing rear side of the holder body 11; the signal terminals 22 are respectively mounted in the partition ribs 111 with the mating contact end pieces 221 respectively extended to the bearing surface portions 112 and the bonding end pieces 222 respectively extended out of the rear side of the holder body 11 in coplanar relationship to the bonding end portions 212 of the conducting terminals 21. At this time, the transmission terminals 23 that are respectively extended from the mating contact end pieces 221 are respectively supported on the bearing portions 112. Thereafter, attach the EMI shielding shell 3 to the electrical insulating terminal holder 1 to have the holder body 11 and front bearing portions 112 of the electrical insulating terminal holder 1 be accommodated in the main accommodation chamber 310 and the front extension 12 of the electrical insulating terminal holder 1 be accommodated in the sub accommodation chamber 320 in the sub shell part 32, thereby holding the mating contact end pieces 221 of the signal terminals 22 in a front side in the main accommodation chamber 310 and adjacent to the mount 33 of the EMI shielding shell 3. Thereafter, pivotally connect the metal shielding casing 43 of the swivel adapter 4 to the mount 33 of the EMI shielding shell 3 to face the bottom recess 412 toward the sub shell part 32, and to have the rear bearing portions 423 of the adapter terminals 42 be respectively electrically stopped against the mating contact end pieces 221 of the signal terminals 22. At this time, the electrical insulating terminal holder 1, the conducting terminal set 2, the EMI shielding shell 3 and the swivel adapter 4 are assembled together, forming a combination USB connector.

Further, the metal shielding casing 43 of the swivel adapter 4 and the mount 33 of the EMI shielding shell 3 are pivotally connected together by means of a pivot connection structure 5. The pivot connection structure 5 comprises two pivot holes 50 (or pivot rods 51) respectively formed in two opposite upright lateral walls of the mount 33 of the EMI shielding shell 3, at least one retaining hole 52 (or retaining rod 53) located at the mount 33 at a front side relative to the pivot holes 50 (or pivot rods 51), two extension arms 54 respectively backwardly extended from two opposite sidewalls of the metal shielding casing 43, two pivot rods 51 (or pivot holes 50) respectively perpendicularly extended from the extension arms 54 and respectively pivotally coupled to the pivot holes 50 (or pivot rods 51), and at least one retaining rod 53 (or retaining hole 52) located at the metal shielding casing 43 at a front side relative to the pivot rods 51 (or pivot holes 50) and detachably engageable with the at least one retaining hole 52 (or retaining rod 53) at the mount 33. Thus, the metal shielding casing 43 of the swivel adapter 4 can be biased relative to the mount 33 of the EMI shielding shell 3 between an open position and a close position. When the metal shielding casing 43 of the swivel adapter 4 is closed on the EMI shielding shell 3, the at least one retaining hole 52 (or retaining rod 53) is respectively forced into engagement with the at least one retaining rod 53 (or retaining hole 52), and the bottom recess 412 is forced to abut against the sub shell part 32 of the EMI shielding shell 3.

Further, the width and thickness (height) of the front extension 12 of the electrical insulating terminal holder 1 are smaller than the width and thickness (height) of the holder body 11. Further, the width and thickness (height) of the sub shell part 32 of the EMI shielding shell 3 are smaller than the width and thickness (height) of the main shell part 31. Thus, the main shell part 31 surrounds the holder body 11 of the electrical insulating terminal holder 1 and works with the holder body 11 of the electrical insulating terminal holder 1 and the conducting terminal set 2 to constitute a USB (USB3.0 or 2.0) connector, and the sub shell part 32 of the EMI shielding shell 3 surrounds the front extension 12 of the electrical insulating terminal holder 1 and works with the front extension 12 of the electrical insulating terminal holder 1 and the conducting terminal set 2 to constitute a micro USB connector, and therefore the combination USB connector of the present invention has a wide range of applications.

Further, the main shell part 31 and sub shell part 32 of the EMI shielding shell 3 can be made in integrity. Alternatively, the main shell part 31 and the sub shell part 32 can be separately made, and then connected together using a welding, high-frequency bonding or adhesive bonding technique.

Further, the number of the conducting terminals 21 of the conducting terminal set 2 is five, i.e., the $1^{st}$ grounding terminal 2101, the $1^{st}$ differential signal terminal 2102, the $2^{nd}$ differential signal terminal 2103, the $3^{rd}$ differential signal terminal 2104 and the $4^{th}$ differential signal terminal 2105, wherein the $1^{st}$ grounding terminal 2101 is arranged on the middle, the $1^{st}$ differential signal terminal 2102 and the $4^{th}$ differential signal terminal 2105 are arranged in parallel at two opposite lateral sides relative to the 1 St grounding terminal 2101, and the $2^{nd}$ differential signal terminal 2103 and the $3^{rd}$ differential signal terminal 2104 are arranged in parallel and respectively spaced between the $1^{st}$ grounding terminal 2101 and the $1^{st}$ differential signal terminal 2102 and $4^{th}$ differential signal terminal 2105. The number of the transmission terminals 22 is four, i.e., the $5^{th}$ differential signal terminal 2201, the $6^{th}$ differential signal terminal 2202, the $1^{st}$ power terminal 2203 and the $2^{nd}$ grounding terminal 2204, wherein the $5^{th}$ differential signal terminal 2201 and the $6^{th}$ differential signal terminal 2202 are arranged in parallel between the $1^{st}$ grounding terminal 2101 and the $2^{nd}$ differential signal terminal 2103 and the $3^{rd}$ differential signal terminal 2104; the $1^{st}$ power terminal 2203 and the $2^{nd}$ grounding terminal 2204 are arranged in parallel at two opposite lateral sides relative to the conducting terminals 21. The transmission terminals 23 are respectively extended from the mating contact end pieces 221 of the transmission terminals 22, and classified as the $7^{th}$ differential signal terminal 2301, the $8^{th}$ differential signal terminal 2302, the $2^{nd}$ power terminal 2303, the $3^{rd}$ grounding terminal 2304 and the supplementary transmission terminal 2305, wherein the $7^{th}$ differential signal terminal 2301 and the $8^{th}$ differential signal terminal 2302 are arranged in parallel on the middle; the $2^{nd}$ power terminals 2303 and the $3^{rd}$ grounding terminal 2304 are arranged in parallel at two opposite lateral sides relative to the $7^{th}$ differential signal terminal 2301 and the $8^{th}$ differential signal terminal 2302. The supplementary transmission terminal 2305 is connected to an inner side of the $3^{rd}$ grounding terminal 2304, enabling the transmission terminals 23 to fit USB/OTG specifications. Thus, the 5 pcs of transmission terminals 23 match with the sub shell part 32 of the EMI shielding shell 3 to constitute a micro USB connector providing enhanced EMI protection against surge pulses.

The conducting terminal set 2 further comprises a first isolation terminal 24 spaced between the $2^{nd}$ differential signal terminal 2103 and the $5^{th}$ differential signal terminal 2201, and a second isolation terminal 25 spaced between the $3^{rd}$ differential signal terminal 2104 and the $6^{th}$ differential signal terminal 2202. The first isolation terminal 24 has a first isolation terminal portion 241 located at one end thereof and extended to the space between the $5^{th}$ differential signal terminal 2201 and the $2^{nd}$ grounding terminal 2204, and a bonding end portion 242 located at an opposite end thereof. The second isolation terminal 25 has a second isolation terminal portion 251 located at one end thereof and extended to the space between the $6^{th}$ differential signal terminal 2202 and the $1^{st}$ power terminal 2203, and a bonding end portion 252 located at an opposite end thereof. The first isolation terminal 24 and the second isolation terminal 25 respectively isolate the $5^{th}$ differential signal terminal 2201, the $6^{th}$ differential signal terminal 2202, the $1^{st}$ power terminal 2203 and the $2^{nd}$ grounding terminal 2204, and thus signal transmission through the $5^{th}$ differential signal terminal 2201 and the $6^{th}$ differential signal terminal 2202 is prohibited from interference of the noises or magnetic waves produced by the adjacent power or grounding signals.

Further, the number of the adapter terminals 42 in the terminal holder 41 of the swivel adapter 4 is four, i.e., the $9^{th}$ differential signal terminal 4201 and the $10^{th}$ differential signal terminal 4202 arranged in parallel on the middle, and the $3^{rd}$ power terminal 4203 and the $4^{th}$ grounding terminal 4204 arranged in parallel at two opposite lateral sides. These 4 pcs of adapter terminals 42 are mounted in the accommodation chamber 430 of the metal shielding casing 43 to constitute a USB (USB2.0) connector, The rear bearing portions 423 of the adapter terminals 42 are respective electrically abutted against the mating contact end pieces 221 of the signal terminals 221 for signal transmission.

Referring to FIGS. 5-8 and FIGS. 2 and 4 again, the EMI shielding shell 3 surrounds the electrical insulating terminal holder 1 and the conducting terminal set 2, and the holder body 11 of the electrical insulating terminal holder 1 matched with the conducting terminals 21 and signal terminals 22 of the conducting terminal set 2 and the main shell part 31 of the EMI shielding shell 3 to constitute a USB (USB3.0 or 2.0) connector. Further, the front extension 12 of the electrical insulating terminal holder 1 matched with the transmission terminals 23 of the conducting terminal set 2 and the first sub shell part 32 of the EMI shielding shell 3 to constitute a micro USB connector. Further, the swivel adapter 4 is pivotally connected to the mount 33 of the EMI shielding shell 3. When the swivel adapter 4 is closed on the mount 33 of the EMI shielding shell 3, the terminal holder 41 and metal shielding casing 43 of the swivel adapter 4 cover the top side of the sub shell part 32 of the EMI shielding shell 3, and the rear bearing portions 423 of the adapter terminals 42 are respectively electrically abutted against the mating contact end pieces 221 of the signal terminals 22, and thus the middle contact portions 422 of the adapter terminals 42 and the tongue plate 411 are matched with the metal shielding casing 43 to constitute a USB (USB2.0) connector that can be electrically connected to an external mating electrical connector 6 without causing contact between the power terminals 61 of the external mating electrical connector 6 and the sub shell part 32 of the EMI shielding shell 3, assuring a high level of application safety. At this time, the middle contact portions 422 of the adapter terminals 42 are respectively electrically connected with the signal terminals 22 of the conducting terminal set 2 for signal and power transmission.

After the swivel adapter 4 is turned relative to the mount 33 of the EMI shielding shell 3 from the close position to the open position, the swivel adapter 4 is disposed perpendicular to the electrical insulating terminal holder 1 and the EMI shielding shell 3. At this time, the holder body 11 of the electrical insulating terminal holder 1 matches with the main shell part 31 of the EMI shielding shell 3 to constitute a USB (USB3.0 or 2.0) connector for connection to an external mating USB connector. Thus, the front extension 12 of the electrical insulating terminal holder 1 matches with the sub shell part 32 of the EMI shielding shell 3 to constitute a micro USB connector for connection to an external mating micro USB connector. Thus, the combination USB connector of the present invention has a wide range of applications. Further, subject to the swivel design of the swivel adapter 4, the sub shell part 32 of the EMI shielding shell 3 (micro USB connector) does not interfere with the application of the combination USB connector for connection to an external mating USB (USB2.0) connector.

Figure 9:
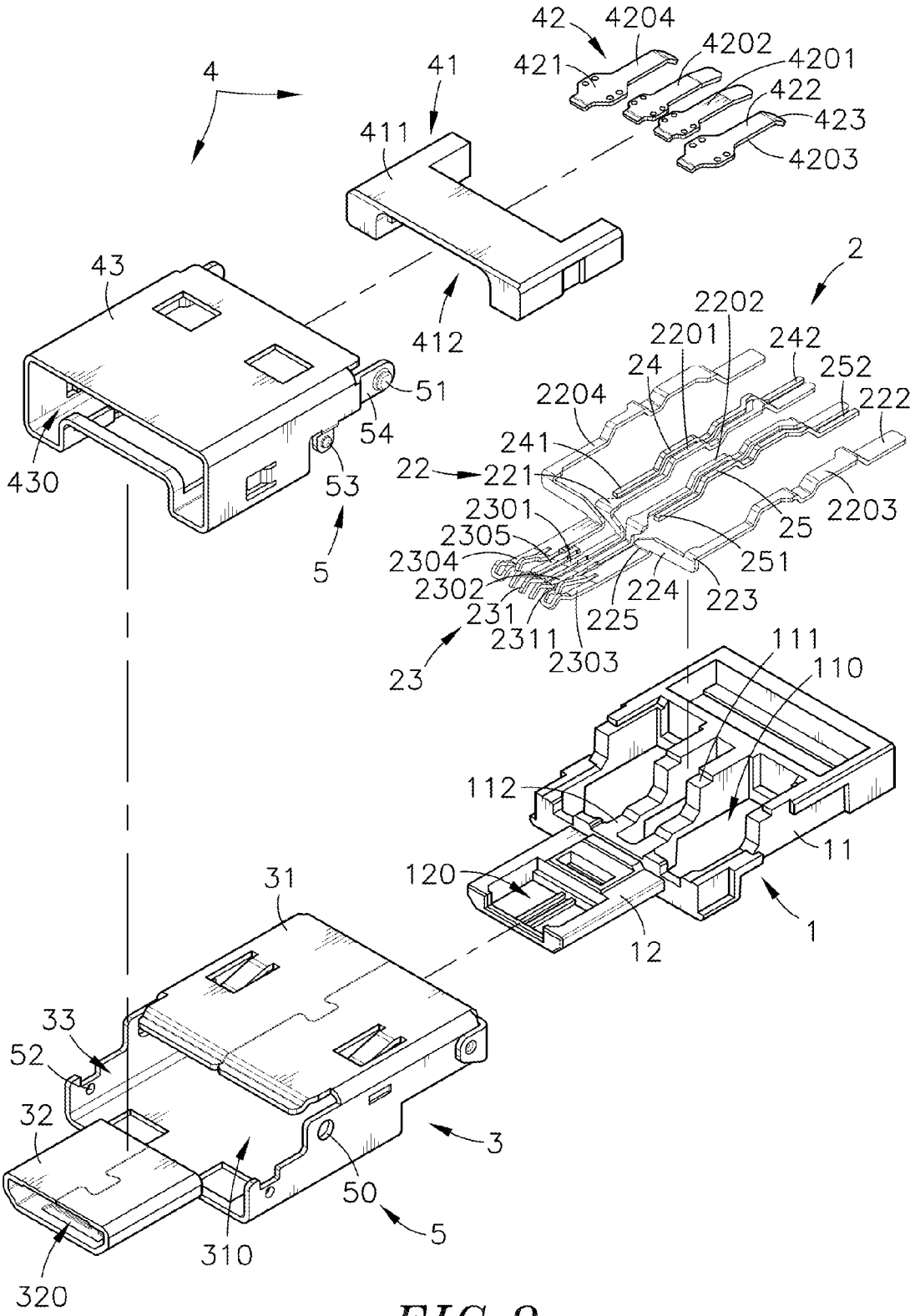
FIG. 9 is an exploded view of a combination USB connector in accordance with a second embodiment of the present invention.
Figure 10:
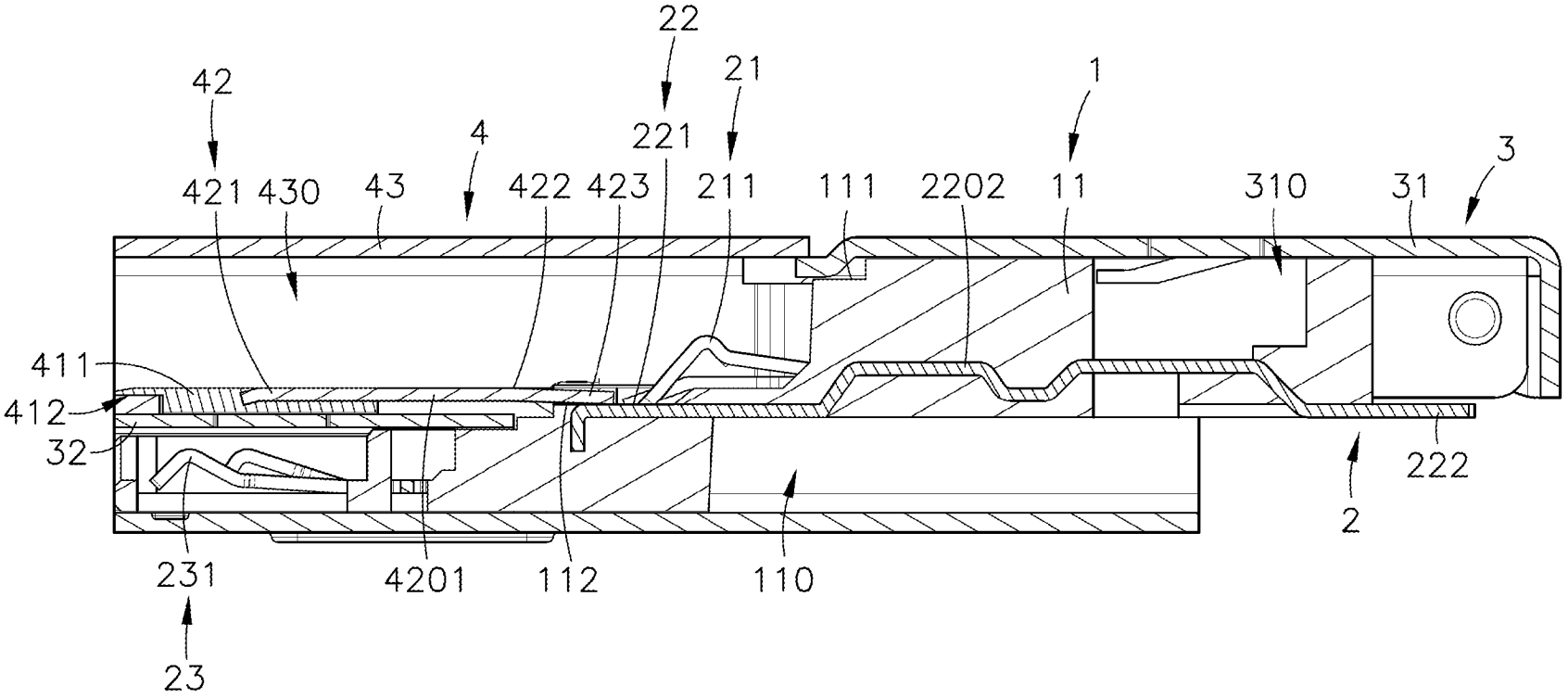
FIG. 10 is a sectional side view of the combination USB connector in accordance with the second embodiment of the present invention.
Figure 11:
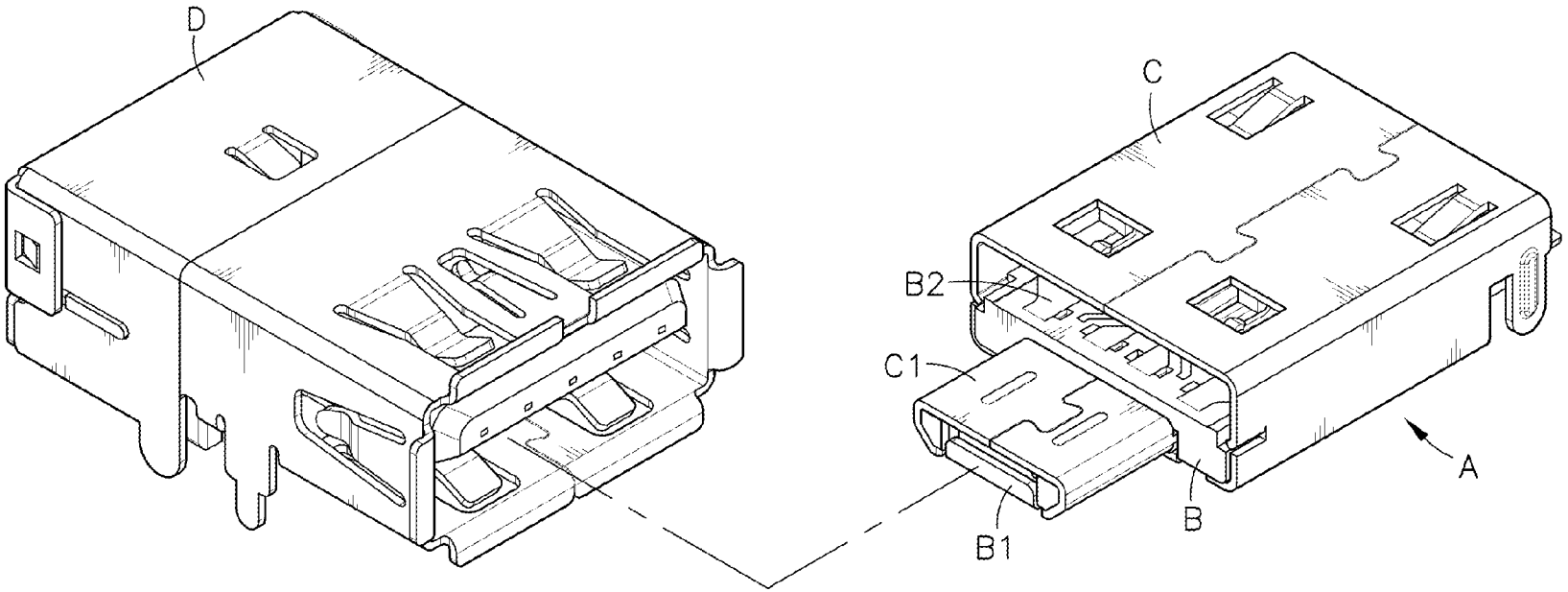
PRIOR ART FIG. 11
FIG. 11 is an exploded view of a USB connector according to the prior art.

Referring to FIGS. 9 and 10, a combination USB connector in accordance with a second embodiment of the present invention is shown. This second embodiment is substantially similar to the aforesaid first embodiment with the exception of the arrangement of the conducting terminal set 2. According to this embodiment, the signal terminals 22 of the conducting terminal set 2 are respectively mounted in the partition ribs 111 of the holder body 11 with the mating contact end pieces 221 respectively extended to the bearing surface portions 112 and the bonding end pieces 222 respectively extended out of the rear side of the holder body 11 of the electrical insulating terminal holder 1; the transmission terminals 23 are respectively extended from the mating contact end pieces 221 of the signal terminals 22 with the contact tips 231 set in the accommodation open space 120 in the front extension 12 of the electrical insulating terminal holder 1. Further, the transmission terminals 23 are respectively extended from the mating contact end pieces 221 of the signal terminals 22, and classified as the $7^{th}$ differential signal terminal 2301, the $8^{th}$ differential signal terminal 2302, the $2^{nd}$ power terminal 2303 and the $3^{rd}$ grounding terminal 2304, wherein the $7^{th}$ differential signal terminal 2301 and the $8^{th}$ differential signal terminal 2302 are arranged in parallel on the middle; the $2^{nd}$ power terminal 2303 and the $3^{rd}$ grounding terminal 2304 are arranged in parallel at two opposite lateral sides relative to the $7^{th}$ differential signal terminal 2301 and the $8^{th}$ differential signal terminal 2302. Further, the contact tips 231 of the $2^{nd}$ power terminal 2303 and $3^{rd}$ grounding terminal 2304 of the transmission terminals 23 are shaped like an open loop, providing two contact surfaces 2311. The conducting terminal set 2 further comprises a supplementary transmission terminal 2305 connected to an inner side of the $3^{rd}$ grounding terminal 2304, enabling the transmission terminals 23 to fit USB/OTG specifications. Thus, after the combination USB connector of the present invention is assembled, the holder body 11 of the electrical insulating terminal holder 1 matches with the conducting terminals 21 and signal terminals 22 of the conducting terminal set 2 and the main shell part 31 of the EMI shielding shell 3 to constitute a USB (USB2.0 or 2.0) connector. Further, the front extension 12 of the electrical insulating terminal holder 1 matches with the transmission terminals 23 of the conducting terminal set 2 and the first sub shell part 32 of the EMI shielding shell 3 to constitute a micro USB connector. Further, the swivel adapter 4 is pivotally connected to the mount 33 of the EMI shielding shell 3. When the swivel adapter 4 is closed on the mount 33 of the EMI shielding shell 3, the terminal holder 41 and metal shielding casing 43 of the swivel adapter 4 cover the top side of the sub shell part 32 of the EMI shielding shell 3, and the rear bearing portions 423 of the adapter terminals 42 are respectively electrically abutted against the mating contact end pieces 221 of the signal terminals 22, and thus the middle contact portions 422 of the adapter terminals 42 and the tongue plate 411 are matched with the metal shielding casing 43 to constitute a USB (USB2.0) connector that can be electrically connected to an external mating electrical connector 6 without causing contact between the power terminals 61 of the external mating electrical connector 6 and the sub shell part 32 of the EMI shielding shell 3, thereby assuring a high level of application safety. Thus, the combination USB connector provides a wide range of applications.

In conclusion, the invention provides a combination USB connector, which comprises an electrical insulating terminal holder 1 comprising a holder body 11 defining a plurality of elongated openings 110, partition ribs 111 and bearing surface portions 112 and a front extension 12 defining an accommodation open space 120, a conducting terminal set 2 comprising a plurality of conducting terminals 21, a plurality of signal terminals 22 and a plurality of transmission terminals 23, an EMI (electromagnetic interference) shielding shell 3 comprising a main shell part 31, a sub shell part 32 and a mount 33, and a swivel adapter 4 comprising a terminal holder 41, a set of adapter terminals 42 and a metal shielding casing 43, wherein the holder body 11 of the electrical insulating terminal holder 1, mating contact end portions 211 of the conducting terminals 21, the signal terminals 22 and the main shell part 31 of the EMI shielding shell 3 constitute a USB3.0 or 2.0 connector; the front extension 12 of the electrical insulating terminal holder 1, contact tips 231 of the transmission terminals 23 and the sub shell part 32 of the EMI shielding shell 3 constitute a micro USB connector. Further, the swivel adapter 4 is pivotally connected the mount 33 of the EMI shielding shell 3, and turnable relative to the EMI shielding shell 3 between a close position and an open position. When the swivel adapter 4 is in the close position, the terminal holder 41 and metal shielding casing 43 of the swivel adapter 4 is covered on the top side of the sub shell part 32 of the EMI shielding shell 3, and the rear bearing portions 423 of the adapter terminals 42 are respectively electrically abutted against the mating contact end pieces 221 of the signal terminals 22, and thus the middle contact portions 422 of the adapter terminals 42 and the tongue plate 411 are matched with the metal shielding casing 43 to constitute a USB (USB2.0) connector that can be electrically connected to an external mating electrical connector 6 without causing contact between the power terminals 61 of the external mating electrical connector 6 and the sub shell part 32 of the EMI shielding shell 3, assuring a high level of application safety.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination USB connector, comprising:

an electrical insulating terminal holder comprising a holder body, a plurality of elongated openings defined in a middle part of said holder body, a plurality of bearing surface portions located at a front side of said holder body, a front extension forwardly extended from said holder body, and an accommodation open space defined in said front extension;

a conducting terminal set comprising a plurality of conducting terminals mounted in the elongated openings in said holder body, a plurality of signal terminals mounted in said holder body and respectively extended to said bearing surface portions, and a plurality of transmission terminals mounted in said accommodation open space of said front extension of said electrical insulating terminal holder, each said conducting terminal comprising a mating contact end portion located at a front end thereof and one elongated opening in said holder body and a bonding end portion located at an opposite rear end thereof and extended out of said holder body, each said signal terminal comprising a mating contact end piece located at a front end thereof and supported on one respective said bearing surface portion and a bonding end piece located at an opposite rear end thereof and extended out of said holder body, said transmission terminals being respectively extended from the mating contact end pieces of said signal terminals and respectively terminating in a respective contact tip and accommodated in said accommodation open space in said front extension;

an EMI shielding shell surrounding said electrical insulating terminal holder, said EMI shielding shell comprising a main shell part, a main accommodation chamber defined in said main shell part and adapted to accommodate said holder body of said electrical insulating terminal holder, a sub shell part forwardly extended from a front bottom side of said main shell part, a sub accommodation chamber defined in said sub shell part in communication with said main accommodation chamber and adapted to accommodate said front extension of said electrical insulating terminal holder, and an open type mount located at said main shell part between said main accommodation chamber and said sub accommodation chamber; and a swivel adapter comprising an insulative terminal holder pivotally connected to said mount of said EMI shielding shell, a set of adapter terminals mounted in said insulative terminal holder and a metal shielding casing surrounding said insulative terminal holder, said insulative terminal holder comprising a tongue plate and an opening, said adapter terminals being mounted in said tongue plate, each said adapter terminal having a front mounting portion mounted in said tongue plate, a rear bearing portion suspending in said opening of said insulative terminal holder and a middle contact portion connected between said front mounting portion and said rear bearing portion and suspending in said opening of said insulative terminal holder.

2. The combination USB connector as claimed in claim 1, wherein the width and thickness of said front extension of said electrically insulative terminal holder are relatively smaller than the width and thickness of said holder body.

3. The combination USB connector as claimed in claim 1, wherein said front extension is forwardly extended from a lower middle part of a front side of said holder body, and the width and thickness of said front extension of said electrically insulative terminal holder are relatively smaller than the width and thickness of said holder body.

4. The combination USB connector as claimed in claim 3, wherein the contact tips of two said transmission terminals that are disposed at two opposite lateral sides relative to the other said transmission terminals are shaped like an open loop, each defining two contact surfaces.

5. The combination USB connector as claimed in claim 1, wherein said rear bearing portions of said adapter terminals are respectively electrically stopped against said mating contact end pieces of said signal terminals.

6. The combination USB connector as claimed in claim 1, wherein said signal terminals are respectively spaced among said conducting terminals and respectively positioned in said holder body.

7. A combination USB connector, comprising:

an electrical insulating terminal holder comprising a holder body, a plurality of elongated openings defined in a middle part of said holder body, a plurality of bearing surface portions located at a front side of said holder body, a front extension forwardly extended from said holder body, and an accommodation open space defined in said front extension;

a conducting terminal set comprising 5 pcs of conducting terminals mounted in the elongated openings in said holder body, 4 pcs of signal terminals mounted in said holder body and respectively extended to said bearing surface portions and 5 pcs of transmission terminals mounted in said accommodation open space of said front extension of said electrical insulating terminal holder, said 5 pcs of conducting terminals being classified as $1^{st}$ grounding terminal, $1^{st}$ differential signal terminal, $2^{nd}$ differential signal terminal, $3^{rd}$ differential signal terminal and $4^{th}$ differential signal terminal, said $1^{st}$ grounding terminal being arranged on the middle, said $1^{st}$ differential signal terminal and said $4^{th}$ differential signal terminal being arranged in parallel at two opposite lateral sides relative to said $1^{st}$ grounding terminal, said $2^{nd}$ differential signal terminal and said $3^{rd}$ differential signal terminal being arranged in parallel and respectively spaced between said $1^{st}$ grounding terminal and said $1^{st}$ differential signal terminal and between said $1^{st}$ grounding terminal and $4^{th}$ differential signal terminal, said 4 pcs of signal terminals being classified as $5^{th}$ differential signal terminal, $6^{th}$ differential signal terminal, $1^{st}$ power terminal and $2^{nd}$ grounding terminal, said $5^{th}$ differential signal terminal and said $6^{th}$ differential signal terminal being arranged in parallel between said $1^{st}$ grounding terminal and said $2^{nd}$ differential signal terminal and between said $1^{st}$ grounding terminal and said $3^{rd}$ differential signal terminal, said $1^{st}$ power terminal and said $2^{nd}$ grounding terminal being arranged in parallel at two opposite lateral sides relative to said conducting terminals, said transmission terminals being classified as $7^{th}$ differential signal terminal, $8^{th}$ differential signal terminal, $2^{nd}$ power terminal, $3^{rd}$ grounding terminal and supplementary transmission terminal, said $7^{th}$ differential signal terminal and said $8^{th}$ differential signal terminal being arranged in parallel on the middle, said $2^{nd}$ power terminal and said $3^{rd}$ grounding terminal being arranged in parallel at two opposite lateral sides relative to said $7^{th}$ differential signal terminal and said $8^{th}$ differential signal terminal, said $7^{th}$ differential signal terminal, said $8^{th}$ differential signal terminal, said $2^{nd}$ power terminal and said $3^{rd}$ grounding terminal being respectively extended from said mating contact end pieces of said transmission terminals, said supplementary transmission terminal being connected to an inner side of said $3^{rd}$ grounding terminal, each said conducting terminal comprising a mating contact end portion located at a front end thereof and one elongated opening in said holder body and a bonding end portion located at an opposite rear end thereof and extended out of said holder body, each said signal terminal comprising a mating contact end piece located at a front end thereof and supported on one respective said bearing surface portion and a bonding end piece located at an opposite rear end thereof and extended out of said holder body, said transmission terminals being respectively extended from said signal terminals and respectively terminating in a respective contact tip and accommodated in said accommodation open space in said front extension;

an EMI shielding shell surrounding said electrical insulating terminal holder, said EMI shielding shell comprising a main shell part, a main accommodation chamber defined in said main shell part and adapted to accommodate said holder body of said electrical insulating terminal holder, a sub shell part forwardly extended from a front bottom side of said main shell part, a sub accommodation chamber defined in said sub shell part in communication with said main accommodation chamber and adapted to accommodate said front extension of said electrical insulating terminal holder, and an open type mount located at said main shell part between said main accommodation chamber and said sub accommodation chamber, said main shell part matching with said 5 pcs of conducting terminals and said 4 pcs of signal terminals to constitute a USB3.0 connector, said sub shell part matching with said 5 pcs of transmission terminals to constitute a micro USB connector; and a swivel adapter comprising an insulative terminal holder pivotally connected to said mount of said EMI shielding shell, 4 pcs of adapter terminals mounted in said insulative terminal holder and a metal shielding casing surrounding said insulative terminal holder, said insulative terminal holder comprising a tongue plate and an opening, said adapter terminals being mounted in said tongue plate, each said adapter terminal having a front mounting portion mounted in said tongue plate, a rear bearing portion suspending in said opening of said insulative terminal holder and a middle contact portion connected between said front mounting portion and said rear bearing portion and suspending in said opening of said insulative terminal holder, said 4 pcs of adapter terminals being classified as $9^{th}$ differential signal terminal, $10^{th}$ differential signal terminal, $3^{rd}$ power terminal and $4^{th}$ grounding terminal, said $9^{th}$ differential signal terminal and said $10^{th}$ differential signal terminal being arranged in parallel on the middle, said $3^{rd}$ power terminal and said $4^{th}$ grounding terminal being arranged in parallel at two opposite lateral sides.

8. The combination USB connector as claimed in claim 7, wherein each said signal terminal further comprises a first bend vertically downwardly extended from the mating contact end piece thereof, an extension arm extended from said first bend, and a second bend extended from said extension arm; said transmission terminals are respectively horizontally connected to the second bends of said signal terminals; said transmission terminals are respectively extended from said signal terminals, the contact tips of said $2^{nd}$ power terminal and said $3^{rd}$ grounding terminal being shaped like an open loop and respectively defining two contact surfaces.

9. The combination USB connector as claimed in claim 7, wherein the mating contact end portions of said $1^{st}$ grounding terminal, said $1^{st}$ differential signal terminal, said $2^{nd}$ differential signal terminal, said $3^{rd}$ differential signal terminal and said $4^{th}$ differential signal terminal are reversely curved.

10. The combination USB connector as claimed in claim 7, wherein said supplementary transmission terminal is connected to an inner side of said $3^{rd}$ grounding terminal, enabling said 5 pcs of transmission terminals to fit USB/OTG specifications.

11. The combination USB connector as claimed in claim 7, wherein said transmission terminals of said conducting terminal set are configured to meet USB specifications, and said supplementary transmission terminal is connected to an inner side of said $3^{rd}$ grounding terminal, enabling said 5 pcs of transmission terminals to fit USB/OTG specifications.

12. A combination USB connector, comprising:

an electrical insulating terminal holder comprising a holder body defining a plurality of bearing surface portions, a front extension forwardly extended from said holder body, and an accommodation open space defined in said front extension;

a conducting terminal set comprising 4 pcs of signal terminals mounted in said holder body and respectively extended to said bearing surface portions and 5 pcs of transmission terminals mounted in said accommodation open space of said front extension of said electrical insulating terminal holder, each said signal terminal comprising a mating contact end piece located at a front end thereof and supported on one respective said bearing surface portion and a bonding end piece located at an opposite rear end thereof and extended out of said holder body, said transmission terminals being respectively extended from the mating contact end pieces of said signal terminals and respectively terminating in a respective contact tip and accommodated in said accommodation open space in said front extension;

an EMI shielding shell surrounding said electrical insulating terminal holder, said EMI shielding shell comprising a main shell part, a main accommodation chamber defined in said main shell part and adapted to accommodate said holder body of said electrical insulating terminal holder, a sub shell part forwardly extended from a front bottom side of said main shell part, a sub accommodation chamber defined in said sub shell part in communication with said main accommodation chamber and adapted to accommodate said front extension of said electrical insulating terminal holder, and an open type mount located at said main shell part between said main accommodation chamber and said sub accommodation chamber; and a swivel adapter comprising an insulative terminal holder pivotally connected to said mount of said EMI shielding shell, a set of adapter terminals mounted in said insulative terminal holder and a metal shielding casing surrounding said insulative terminal holder, said insulative terminal holder comprising a tongue plate and an opening, said adapter terminals being mounted in said tongue plate, each said adapter terminal having a front mounting portion mounted in said tongue plate, a rear bearing portion suspending in said opening of said insulative terminal holder and a middle contact portion connected between said front mounting portion and said rear bearing portion and suspending in said opening of said insulative terminal holder.

13. The combination USB connector as claimed in claim 12, wherein said 4 pcs of signal terminals, said 4 pcs of signal terminals being classified as $5^{th}$ differential signal terminal, $6^{th}$ differential signal terminal, $1^{st}$ power terminal and $2^{nd}$ grounding terminal, said $5^{th}$ differential signal terminal and said $6^{th}$ differential signal terminal being arranged in parallel between said $1^{st}$ grounding terminal and said $2^{nd}$ differential signal terminal and between said $1^{st}$ grounding terminal and said $3^{rd}$ differential signal terminal, said $1^{st}$ power terminal and said $2^{nd}$ grounding terminal being arranged in parallel at two opposite lateral sides relative to said conducting terminals, said 5 pcs of transmission terminals being classified as $7^{th}$ differential signal terminal, $8^{th}$ differential signal terminal, $2^{nd}$ power terminal, $3^{rd}$ grounding terminal and supplementary transmission terminal, said $7^{th}$ differential signal terminal and said $8^{th}$ differential signal terminal being arranged in parallel on the middle, said $2^{nd}$ power terminal and said $3^{rd}$ grounding terminal being arranged in parallel at two opposite lateral sides relative to said $7^{th}$ differential signal terminal and said $8^{th}$ differential signal terminal, said $7^{th}$ differential signal terminal, said $8^{th}$ differential signal terminal, said $2^{nd}$ power terminal and said $3^{rd}$ grounding terminal being respectively extended from said mating contact end pieces of said transmission terminals, said supplementary transmission terminal being connected to an inner side of said $3^{rd}$ grounding terminal; said main shell part matches with said 4 pcs of signal terminals to constitute a USB2.0 connector; said sub shell part matches with said 5 pcs of transmission terminals to constitute a micro USB connector.

14. The combination USB connector as claimed in claim 12, wherein the contact tips of said $2^{nd}$ power terminal and said $3^{rd}$ grounding terminal are shaped like an open loop, each defining two contact surfaces.

15. The combination USB connector as claimed in claim 12, wherein said supplementary transmission terminal is connected to an inner side of said $3^{rd}$ grounding terminal, enabling said 5 pcs of transmission terminals to fit USB/OTG specifications.

* * * * *